US005950612A

United States Patent [19]

Zuzelo et al.

[11] Patent Number: 5,950,612

[45] Date of Patent: Sep. 14, 1999

[54] APPARATUS FOR CUTTING CONCRETE

[75] Inventors: Edward A. Zuzelo, 622 Broad Acres Rd., Narberth, Pa. 19072; Albert D. Alderman, Jr., Skippack, Pa.

[73] Assignee: Edward A. Zuzelo, Narberth, Pa.

[21] Appl. No.: 08/954,511

[22] Filed: Oct. 20, 1997

[51] Int. Cl.[6] ..... B28D 1/04

[52] U.S. Cl. ..... 125/13.01; 125/13.03

[58] Field of Search ..... 125/13.01, 13.03; 83/928, 488, 563

[56] References Cited

U.S. PATENT DOCUMENTS

| | | | |
|---|---|---|---|
| 4,769,201 | 9/1988 | Chiuminatta et al. . | |
| 4,928,662 | 5/1990 | Chiuminatta et al. . | |
| 4,938,201 | 7/1990 | Chiuminatta et al. . | |
| 5,184,597 | 2/1993 | Chiuminatta et al. . | |
| 5,303,688 | 4/1994 | Chiuminatta et al. . | |
| 5,305,729 | 4/1994 | Chiuminatta et al. . | |
| 5,373,834 | 12/1994 | Chiuminatta et al. . | |
| 5,676,126 | 10/1997 | Rupprecht et al. | 125/13.03 |
| 5,709,200 | 1/1998 | Mertes | 125/13.01 |

*Primary Examiner*—David A. Scherbel
*Assistant Examiner*—Shantese McDonald
*Attorney, Agent, or Firm*—Panitch Schwarze Jacobs & Nadel, P.C.

[57] ABSTRACT

A self-propelled saw for cutting green or uncured concrete having a frame with rear drive wheels and adjustable front wheels is provided. The saw has a handle for guiding it along the desired path to be cut in the concrete and a drive motor for the saw blade and the rear wheels mounted on the frame. Motor or pump driven means interconnecting the handle and front wheels raise and lower the front wheels at the control of the operator to remove or insert the saw blade into the concrete to be cut. A track assembly, including a pair of parallel tracks moves with the frame as the saw blade is inserted into the concrete and the tracks engage and roll along the surface of the concrete to support the surf ace adjacent the saw blade as the concrete is being cut.

34 Claims, 13 Drawing Sheets

APPARATUS FOR CUTTING CONCRETE

BACKGROUND OF THE INVENTION

The present invention relates to saws for cutting concrete and, more particularly, to saws for cutting green concrete. Green concrete, as used herein, is concrete less than approximately 36 hours after pouring.

Large concrete slabs are prone to cracking as a result of contraction as they cure. Uncontrolled, such cracks may form anywhere within the concrete slab.

One method of controlling the formation and location of cracks in the slab is to provide grooves in the concrete before the concrete is fully set. Since the slab is weakest along the cross sectional plane defined by the groove, if the groove is deep enough relative to the thickness of the concrete slab, potential stress cracks in the curing concrete slab will form along the grooves rather than randomly in ungrooved expanses of the concrete slab. After the concrete is completely cured, stress cracks which form along the predefined grooves in the concrete can be filled with a suitable filler.

Several methods and devices are known for creating such stress-cracks in concrete slabs. One method is to form grooves with a hand held tool, such as a trowel, while the concrete is soft enough to be worked by hand. Another method is to use a saw to cut grooves before the concrete is set.

One type of saw to cut grooves in concrete is disclosed in U.S. Pat. No. 5,056,499. This patent discloses a concrete cutting saw having a slotted skid plate through which a circular saw plate projects to cut the concrete. One disadvantage of concrete saws of the type disclosed in this above patent in that the maximum depth of cut is in the range of one and one-quarter to one and three-quarters inches in depth. Shallow cuts such as these are often not sufficient for providing stress planes in thick concrete slabs. The limitation in the depth of cut in devices such as those in the above-referenced patent is due to the requirement for relatively light weight, and thus low power, so that the saw does not unduly mark the surface of the green concrete. Another disadvantage is, that despite its light weight, it can still mark the surface of green concrete as the skid plate is pushed over the concrete surface even when cutting green concrete.

In view of the foregoing, it is a principal object of the present invention to provide a concrete cutting saw that can cut green or uncured concrete and which has the power and weight to cut to a depth of at least three inches, but will not unduly mark the surface of green or uncured concrete.

Another object of the present invention is to provide a green or uncured concrete cutting saw which will maintain the integrity of the-surface of the concrete being cut.

Another object of the present invention is to provide a concrete cutting saw for green or cured concrete, or bituminous concrete, which can drive itself along the surface of the concrete at a desired preselected speed while cutting the concrete at a desired depth, without marring the surface of green concrete.

A still further object of the present invention is to provide a green or uncured concrete cutting saw having continuous smooth tracks which roll over the concrete adjacent each side of the saw blade to support the surface and more importantly stabilize the saw to prevent vibration and subsequent raveling of the concrete adjacent the cut.

Additional objects and advantages of the present invention and the novel features and details thereof will become apparent to those skilled in the art from the detailed description of the invention.

SUMMARY OF THE PRESENT INVENTION

A self propelled saw for cutting green or uncured concrete is provided having a frame supported by rear drive wheels, adjustable front wheels and a handle for directing the saw across the surface of concrete to be cut. The saw includes a motor drive carried by the frame to rotate a saw blade and to drive the rear wheels of the saw. The front wheels of the saw are movable toward and away from the frame to permit the operator to lower the saw blade into the concrete at the start of the cutting operation and elevate the saw blade when the cut is completed. In addition, the saw includes a track assembly which completely encloses the saw blade when the blade is disengaged from the concrete and which has a pair of spaced parallel tracks that ride on the surface of the concrete during the cutting operation and support the concrete during cutting to prevent raveling of the concrete adjacent the cut.

DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
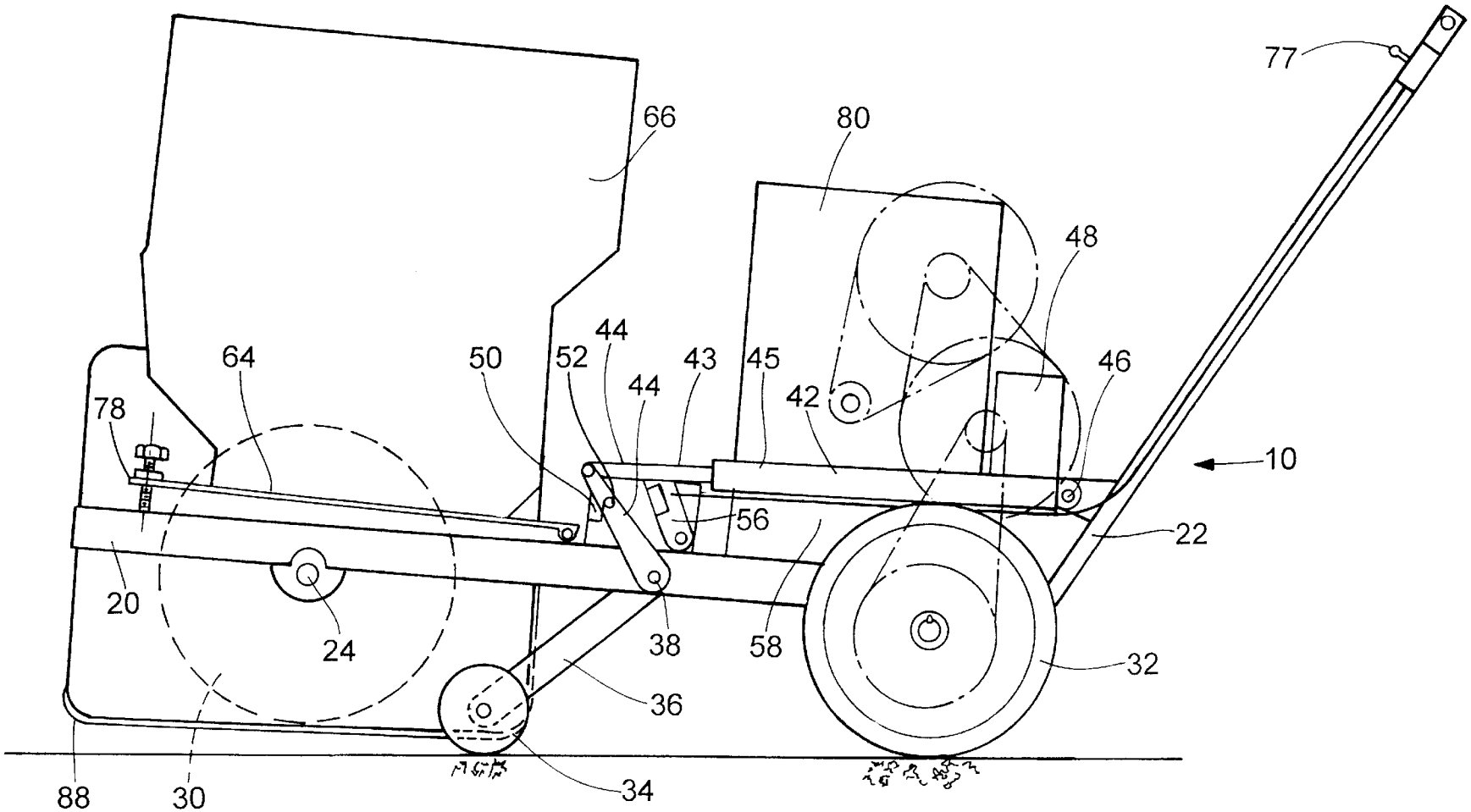
FIG. 1 is a right side elevational view of the concrete cutting saw of the present invention.

Certain terminology is used in the following description for convenience only and is not limiting. The words "right,"

"left," "lower" and "upper" designate directions in the drawings to which reference is made. The words "inwardly" and "outwardly" refer to directions toward and away from, respectively, the geometric center of the concrete saw 10, and designated parts thereof. The terminology includes the words specifically mentioned above, derivatives thereof and words of similar import.

Referring to FIGS. 1 through 6, the concrete saw 10 of the present invention includes a main frame 20 to which a handle 22 is fixed. A rotatable saw blade shaft 24 supporting a blade arbor 26 is mounted in bearings 28, 29 secured to the main frame 20. The saw blade 30 is mounted on the blade arbor 26 in the conventional manner. The main frame 20 is supported at its rear end or handle end by a plurality of driven wheels 32. The forward end of the main frame 20 is adjustably supported by means of a pair of wide rollers 34 carried by an adjustable bracket 36 pinned or keyed to a rotatable shaft 38. A crank arm 40, also keyed to the shaft 38, is provided to rotate the shaft 38 to raise or lower the forward end of the main frame 20. When the forward end of the main frame 20 is in its raised position, the saw blade 30 is out of engagement with the concrete to be cut. Similarly, lowering the forward end of the main frame 20 will cause the blade 30 to engage and cut the concrete.

Figure 6:
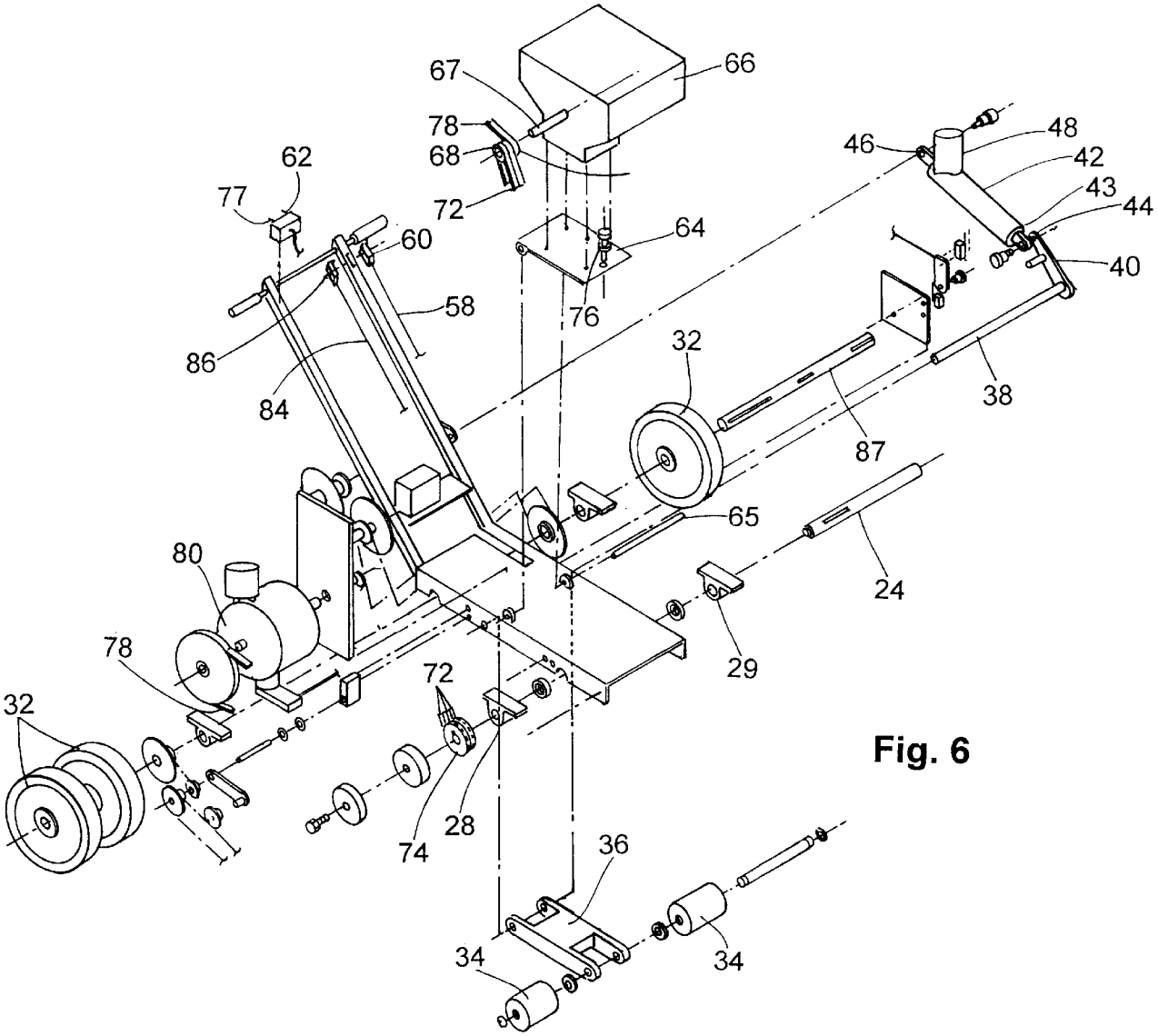
FIG. 6 is an exploded view of some of the elements of the concrete saw of the present invention.

Movement of the main frame 20 to engage or disengage the saw blade 30 from the concrete is controlled by an extendable linkage mechanism 42, shown in FIG. 6, having one end 44 pivotally connected to the upper end of the crank arm 40 and the other end 46 connected to the handle 22. Extension and retraction of the linkage mechanism 42 may be accomplished in any conventional manner, such as by a rotatable feed screw or hydraulic piston 43 within a cylinder 45 driven by a 25 reversible DC motor or a hydraulic pump 48. As the linkage mechanism 42 is extended, the crank arm 40 and bracket 36 are rotated counter-clockwise relative to FIG. 1, thereby elevating the forward end of the frame 20. Similarly, retracting the linkage mechanism 42 will lower the forward end of the frame 20, engaging the saw blade 30 into the concrete as shown in FIG. 2 of the drawings.

Figure 2:
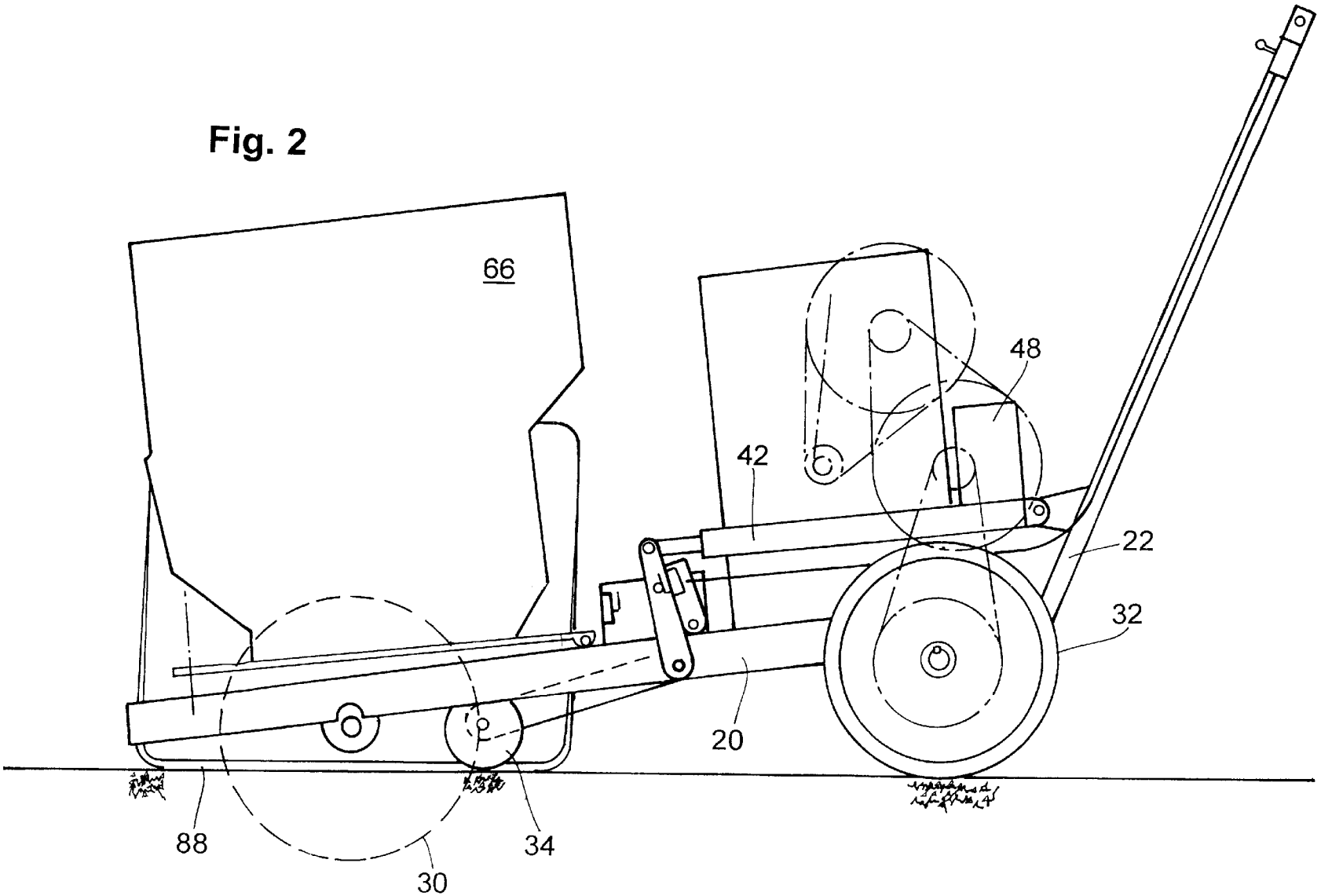
FIG. 2 is a view similar to FIG. 1 with the saw blade lowered to its cutting position.

Still with reference to FIG. 1, the retracted position of the saw blade 30 is controlled by a fixed limit switch 50 supported by the frame 20, which, when engaged by a pin 52 on the crank arm 40, will stop forward movement of the crank arm. The depth of engagement of the saw blade 30 is controlled by a second limit switch 54 carried by a pivoted arm 56 whose position is controlled by a control cable 58 connected to a depth control lever 60 on the handle 22, as shown in FIG. 6. A reversing switch 62, also mounted on the handle 22, is utilized to operate the motor or hydraulic pump 48 to raise or lower the saw blade 30.

Pivoted to the frame 22 via a pin 65 is motor support plate 64 which carries the drive motor 66 for the saw. The motor 66, which is preferably a gasoline motor, has a horizontal drive shaft 67 extending transversely of the concrete saw which in turn has two drive pulleys 68 and 70 thereon. The first drive pulley 68 has two sheaves and is connected by twin drive belts 72 to a two sheave pulley 74 on the saw blade shaft 24 to drive the saw blade at a constant speed in a clockwise direction relative to FIG. 1. A threaded bolt 76 extending through the motor support plate 64 into engagement with the frame 22 may be used to lower or elevate the motor 66 relative to the saw blade shaft 24 to control the tension on the twin saw blade drive belts 72. For convenience and safety, a switch 77 on the handle 22 may be used to start and stop the motor 66.

Figure 3:
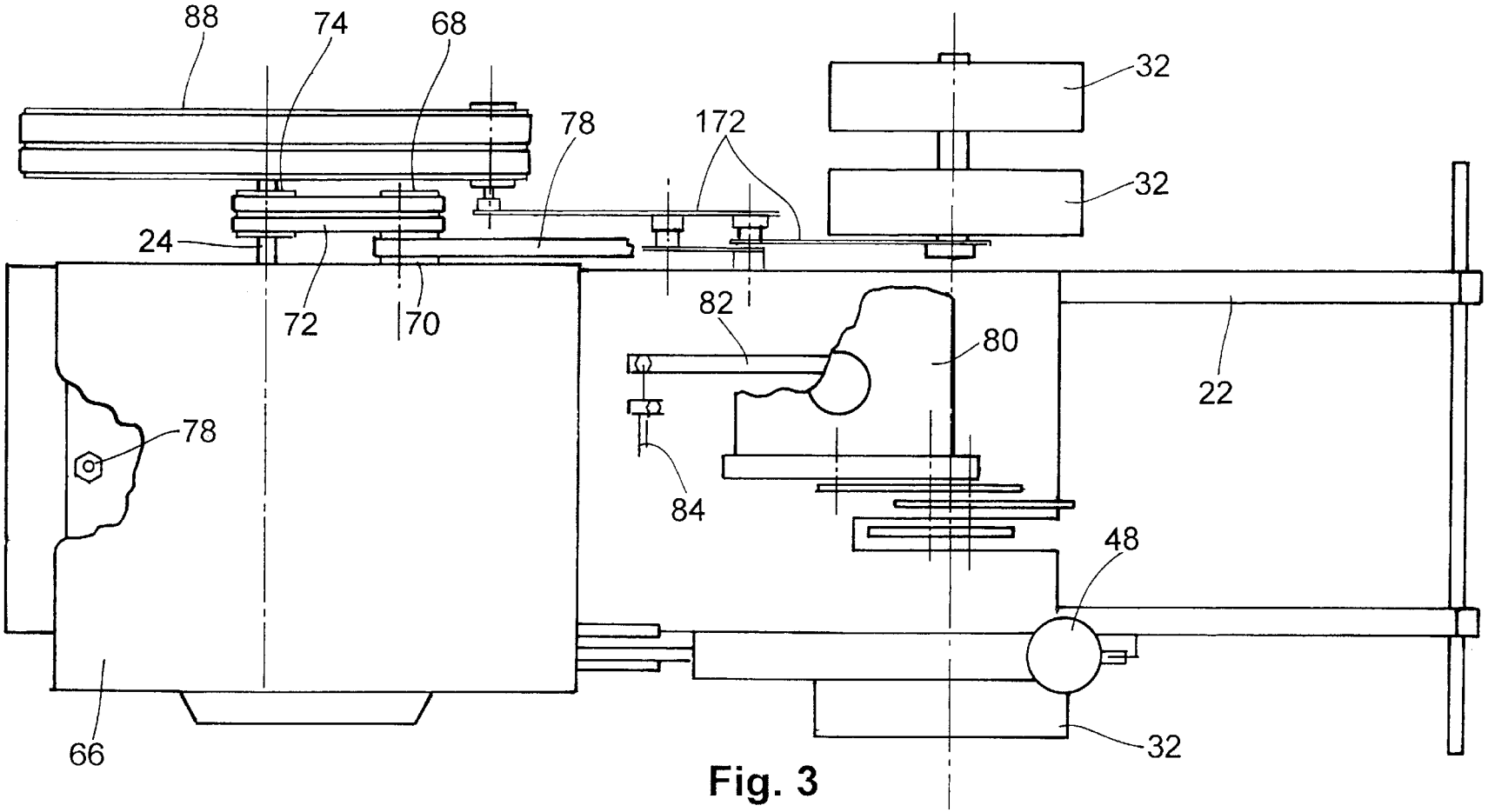
FIG. 3 is a plan view of the concrete cutting saw of the present invention.

According to the present invention, the concrete saw 10 is motor driven at a speed controlled by the operator to drive the machine across the concrete during a cutting operation and to move the machine to new cutting locations. To this end, a drive belt 78 from the second motor drive pulley 70 drives a variable speed transmission 80 which, in turn, drives the rear cutting saw wheels 32. The transmission 80 is preferably a conventional hydrostatic transmission with a direction and speed control lever 82, as shown in FIG. 3. The transmission control lever 82 is operated through a cable 84 from a speed and direction control lever 86 on the handle 22, shown in FIG. 6. It will be recognized by the skilled artisan from the present disclosure that any suitable arrangement of sprocket wheels and drive chain may be used to connect the output of the transmission 80 with the driven rear wheel shaft 87.

An important element of the present invention is the provision of a track assembly 88 which surrounds the saw blade 30, discharges concrete dust from the saw cut through a discharge chute and provides a rolling contact adjacent each side of the saw blade 30 while it is cutting the concrete to support the concrete being cut. One form of the track assembly 88 is illustrated in detail in FIGS. 7 to 12 of the drawings. The track assembly 88 is carried by the frame 20 for movement with and relative to the frame 20, as more fully described hereafter.

Figure 7:
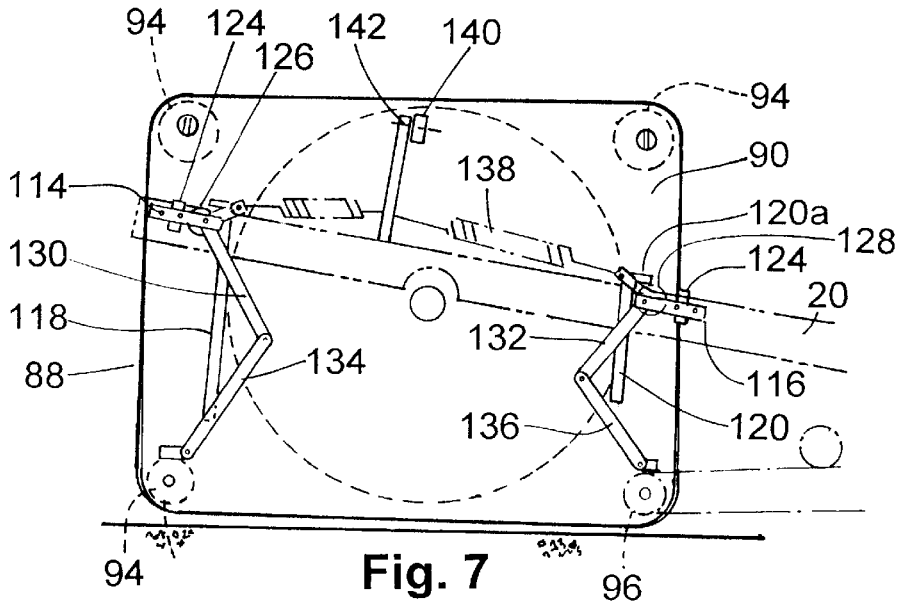
FIG. 7 is a side elevational view of the track assembly of the present invention in the raised position.
Figure 8:
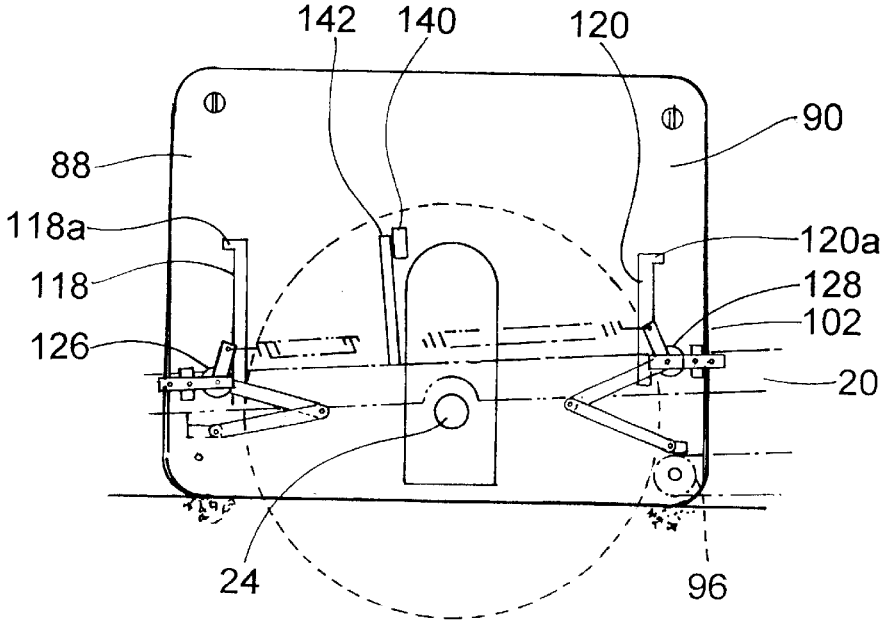
FIG. 8 is view similar to FIG. 7 with the saw blade in its cutting position.
Figure 10:
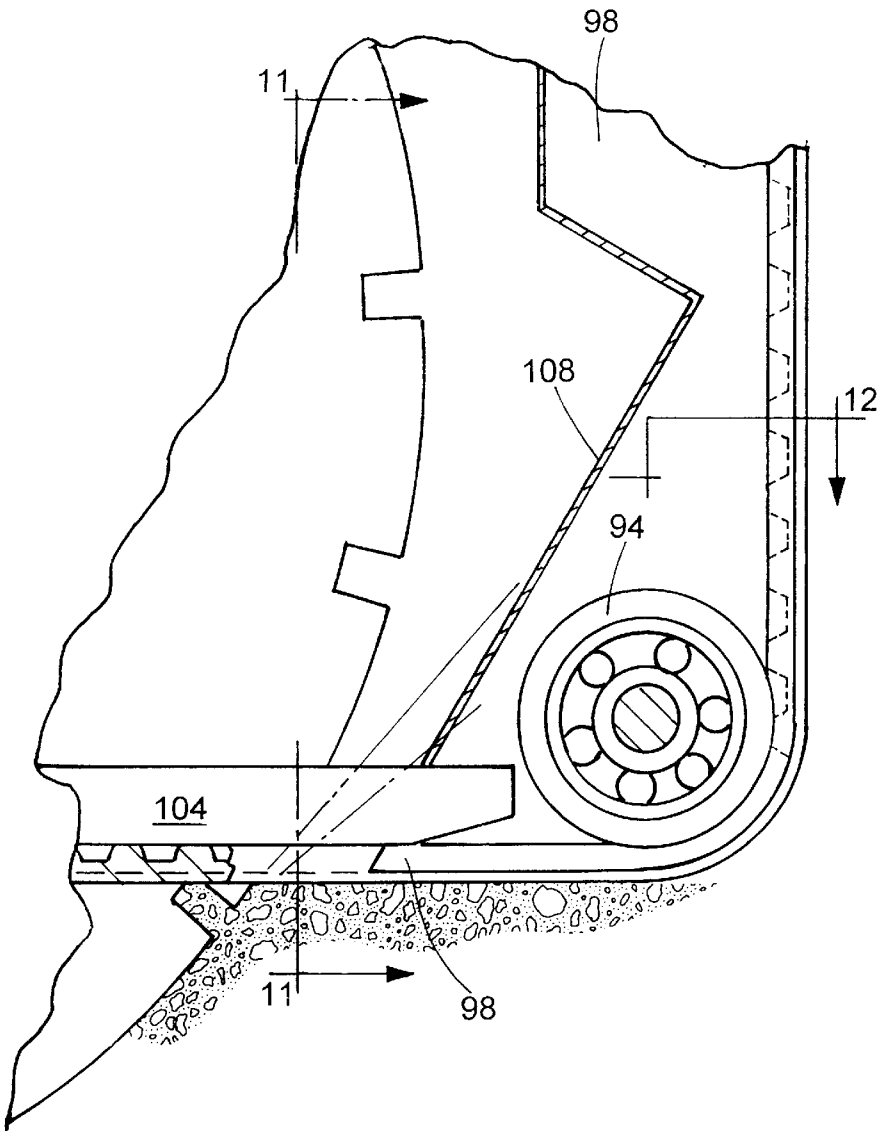
FIG. 10 is an enlarged fragmentary sectional view of the track assembly of FIG. 7.
Figure 10:
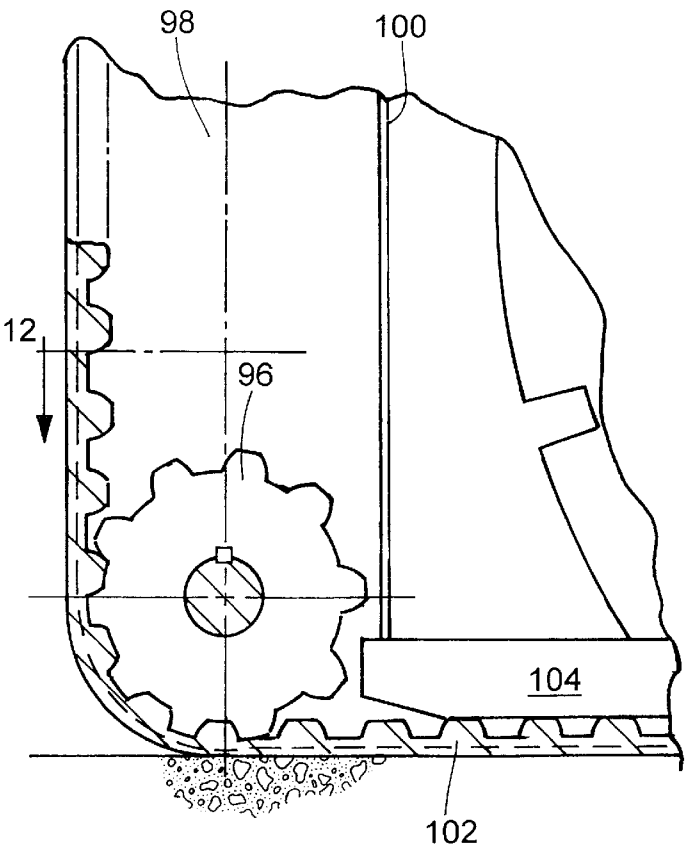
Figure 11:
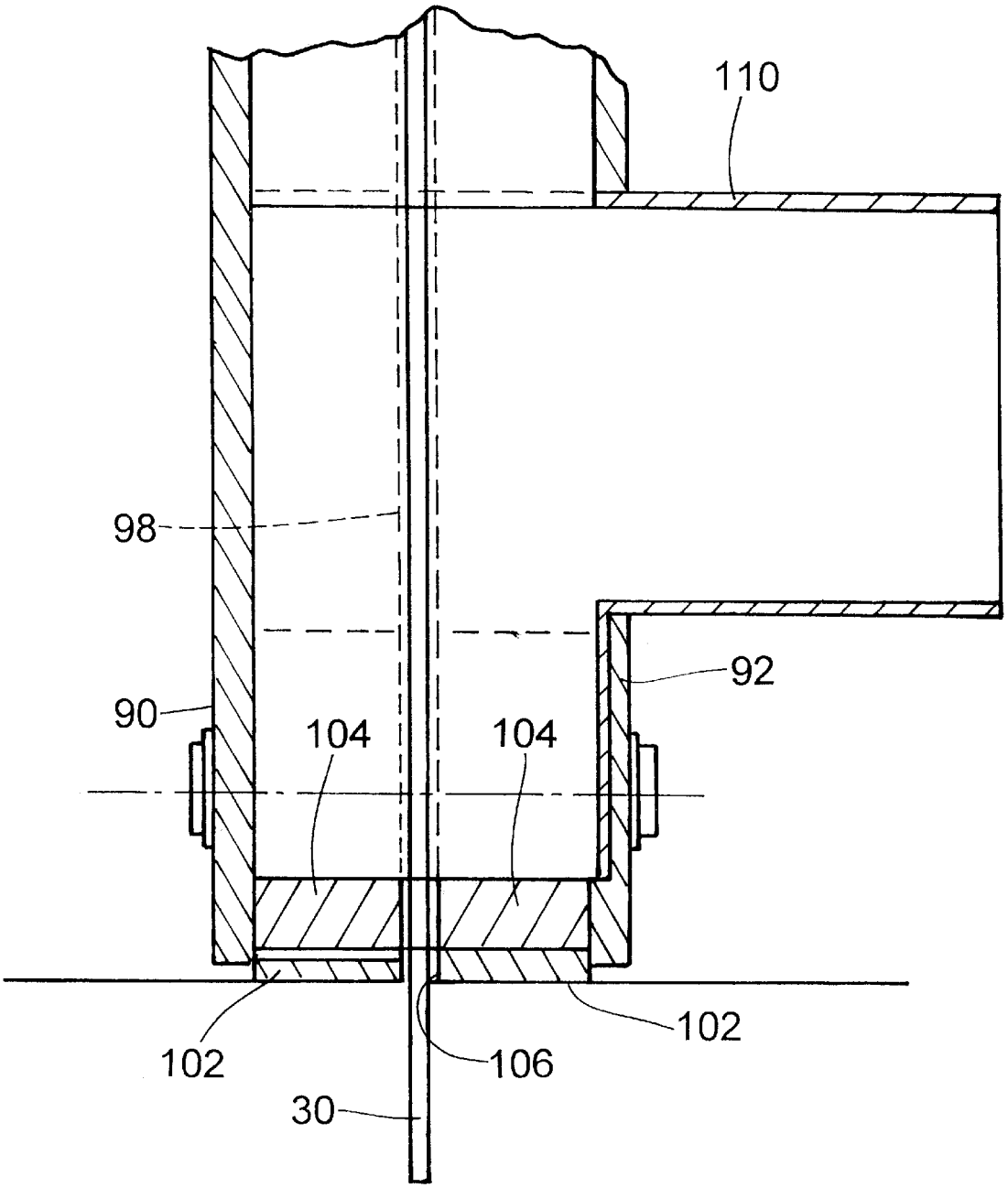
FIG. 11 is a sectional view of the track assembly taken on the line 11—11 of FIG. 10.

As shown in FIGS. 7 and 8, the track assembly 88 includes a generally rectangular back plate 90 facing the frame 20 and a front plate 92 corresponding in shape to the back plate 90. The front and back plates 92, 90 are maintained in a spaced parallel relation on either side of the saw blade 30. At each of three corners of the plates 90 and 92 are a pair of guide rollers 94, while a pair of toothed drive wheels 96, shown in detail in FIG. 10, are provided at the lower rear comer of the plates 90, 92. A central plate 98 having a cutout 100 surrounding the saw blade 30 is positioned intermediate the front and back plates 92, 90 in vertical alignment with the saw blade 30.

In accordance with the present invention, a pair of continuous tracks 102 having a smooth outer surface and a toothed inner surface surround the entire track assembly 88 and engage the surface of the concrete during the cutting operation. The tracks 102 engage the toothed drive wheels 96 and pass over the guide rollers 94 with the outer periphery of the tracks 102 extending beyond the perimeter of the front and back plates 92, 90 at the base of the track assembly 88 a distance equal to about one-half of the track thickness. A pair of guide rails 104 extend lengthwise of the bottom end of the track assembly 88 secured to the inner surface of the front and back plates 92 and 90, respectively. The guide rails 104 extend from a point adjacent to the lower front guide rolls 94 to a point adjacent the drive wheels 96 for the tracks 102 and are spaced apart a short distance to provide a slot 106 for the saw blade 30. These guide rails 104 support the tracks 102 and force the same into engagement with the surface of the concrete during cutting.

Figure 12:
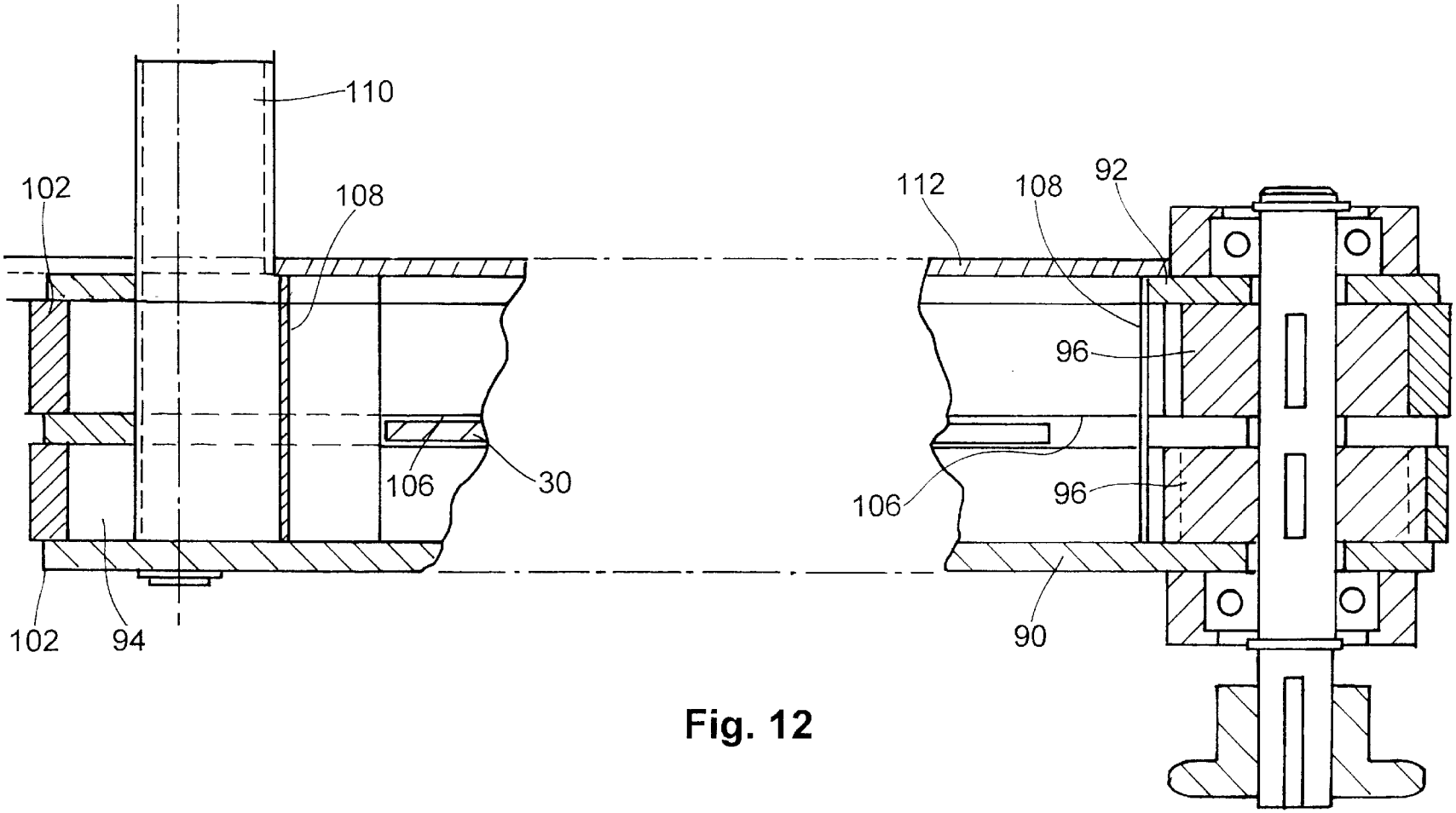
FIG. 12 is a sectional view of the track assembly taken on the line 12—12 of FIG. 10.

Referring to FIGS. 10 and 12, in order to prevent concrete dust from interfering with operation of the tracks 102, a shield 108 is provided which follows the contour of the cutout in the center plate 98, surrounding the saw blade 30 and extending the width of the track assembly 88 from the back plate 90 to the front plate 92. This shield 108 terminates at its lower ends at the top of the guide rails 104. To further protect the tracks 102 and guide rolls 94 from the concrete dust, the center plate 98 follows along the contour of the dust shield at its lower end and projects between and beyond the guide rails 104 to the midpoint of the tracks 102, as best shown in FIG. 10. A discharge duct 110, shown in FIG. 12, is located at the forward end of the front plate 92, and directs the concrete dust off to one side of the cut. A removable cover plate 112 on the front plate 92 of the track assembly 88 provides access to the saw blade 30 for removal or replacement.

Figure 9:
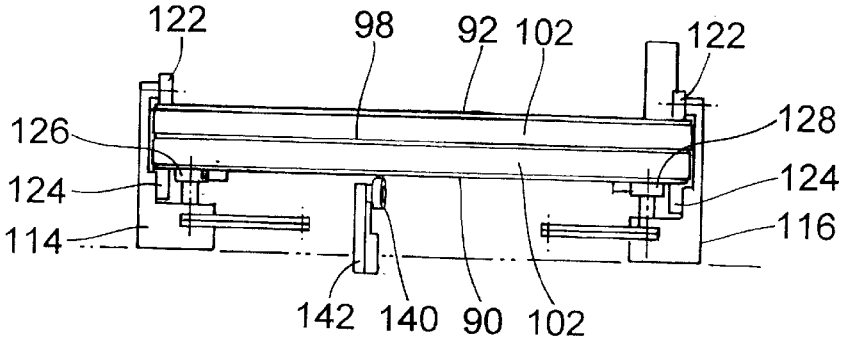
FIG. 9 is a plan view of the track assembly of FIG. 7.

As set forth above, the track assembly 88 is supported from the main frame 20 for movement with the frame 20 toward and away from the concrete surface. The track assembly 88 is also mounted for floating movement relative to the frame 20 so that it will lie flat against the concrete surface at any desired depth of cut and always stay in a position vertical to the surface of the concrete. One mounting mechanism for the track assembly 88 is shown in FIGS. 7, 8 and 9 of the drawings. In this embodiment of the invention, front and rear track guide supports 114 and 116, respectively, are secured to the main frame 20 and fixed guide rails 118 and 120, respectively are secured to the rear plate 90 adjacent the frame 20. The track guide supports project outwardly from the frame 20 and each carry front and rear guide wheels 122 and 124, best illustrated in FIG. 9, which engage, respectively, the front and rear plates 92, 90 of the track assembly. In addition, vertical movement guide wheels 126, 128 also carried by the track guide supports 114 and 116 engage the outer surfaces of the guide rails 118 and 120 to guide vertical movement of the track assembly 88.

As the main frame 20 is moved to its uppermost position, shown in FIG. 7, by the extendable linkage 42, the guide wheels 126 and 128 ride along the fixed guides 118 and 120 until they engage stops 118*a* and 120*a* at the upper end of each guide. Further upward movement of the frame 20 will cause the track assembly to be lifted clear of the concrete surface. The saw blade 30, which also moves with the frame 20, will be clear of the concrete prior to engagement of the stops 118*a*, 120*a* by the vertical guide wheels.

A linkage mechanism is utilized in this embodiment of the invention to permit the track assembly 88 to lie flat against the surface of the concrete and apply the desired pressure on the concrete surface. This linkage mechanism comprises first L-shaped crank arms 130 and 132, each pivotally mounted at the junction of their two legs to the track guide supports 114 and 116, respectively. The lower legs of the crank arms are pivotally connected to links 134, 136 which in turn are pivoted to the rear plate 90 of the track assembly 88. A tension spring 138 interconnects the upper legs of the crank arms 130 and 132 to exert a downward force on the track assembly relative to the main frame 20.

As the forward end of the main frame 20 is lowered to engage the saw blade 30 into the concrete, the track assembly 88 will first engage the concrete. Continued lowering of the main frame 20 to insert the saw blade 30 into the concrete to the desired depth will cause the vertical guide wheels 126 and 128 to ride downwardly along the vertical guides 118 and 120, collapsing the linkage mechanism as shown in FIG. 8. The force of the tension spring 138 exerts a downward force on both the front and rear ends of the track assembly 88, maintaining the same in engagement with the concrete surface. A positioning guide wheel 140 carried by an arm 142 projecting upward from the frame 20 engages the surface of the rear plate 90 to maintain proper vertical alignment of the track assembly.

Another form of support for the track assembly 88 which will also produce the desired engagement of the tracks with the concrete surface during cutting is illustrated in FIGS. 13 to 16 of the drawings. In this form of the invention the track assembly 88 is lowered into engagement with the concrete surface prior to the saw starting its cut and is permitted to rock or tilt back and forth as in the first embodiment shown to insure that the tracks 102 are in engagement with the concrete along the entire length of the track assembly 88. Similarly, as the saw 30 is retracted from the concrete, the track assembly 88 does not leave the surface of the concrete until the saw blade 30 is completely within the track assembly housing.

Figure 13:
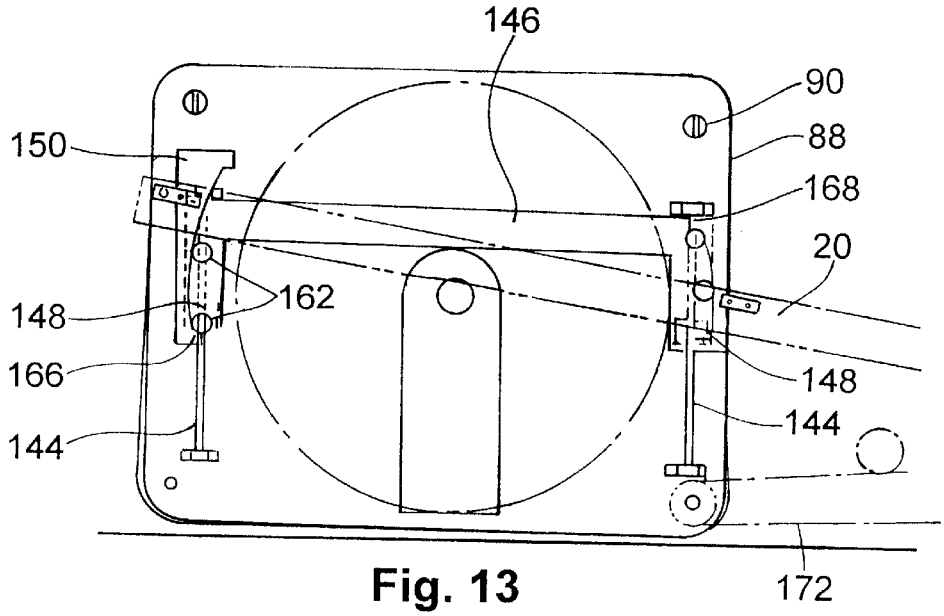
FIG. 13 is a side elevational view of the track assembly of the present invention with modified guide means.
Figure 15:
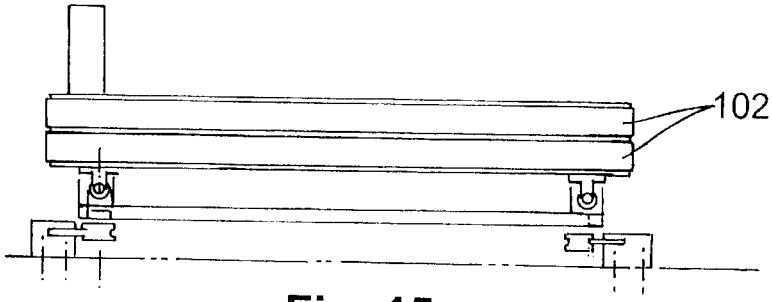
FIG. 15 is a plan view of the track assembly of FIG. 14.
Figure 14:
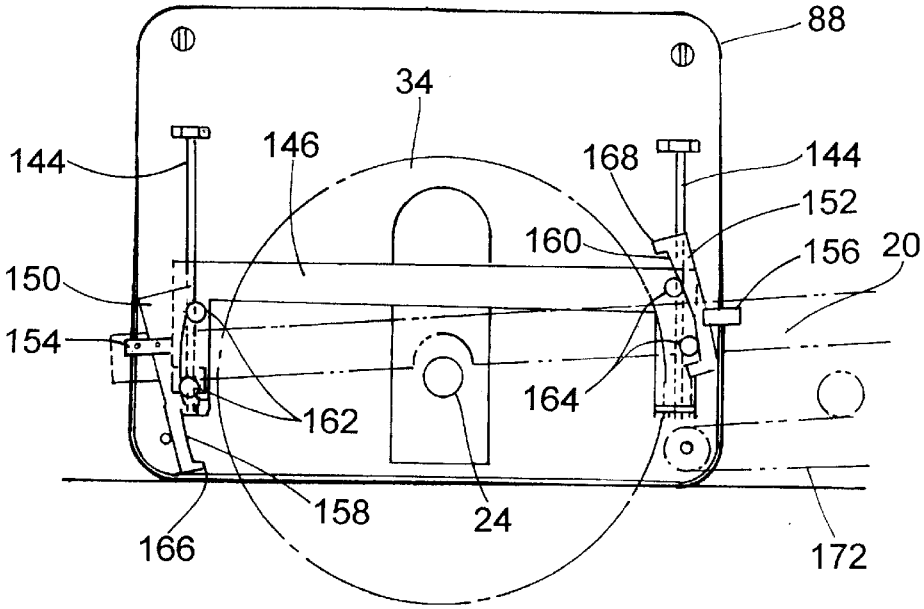
FIG. 14 is a view similar to FIG. 13 with the saw blade in its cutting position.

With reference to FIGS. 13 to 16, a pair of vertical guide rods 144 are mounted in spaced parallel relationship on the rear plate of the track assembly. A floating bar 146 is supported by linear bearings 148 on the guide rods 144 for vertical movement relative to the track assembly 88. The main frame 20 of the concrete saw has guide plates 150 and 152 secured to brackets 154 and 156, respectively, as shown in FIG. 14. The brackets 154, 156 are bolted or otherwise secured to the main frame 20. Each guide plate 150 and 152 has an arcuate inner surface 158 and 160, respectively, concentric with the saw blade. Two pair of guide rollers 162 and 164 carried at opposite sides of the floating bar 146 with one pair in rolling engagement with the arcuate surface of the guide plate 150 and the other pair in rolling engagement with the arcuate surface of the guide plate 152.

When the saw blade 30 is fully retracted from the surface of the concrete, the frame 20 is in its uppermost position as shown in FIG. 13, and a stop 166 at the lower end of the left guide plate 150 engages the lower roller of the pair of rollers 162, holding the floating bar 146 and the track assembly 88 above the surface of the concrete. As the frame 20 is lowered to engage the saw blade into the concrete, a stop 168 at the upper end of the right guide plate 152 engages the upper roller of the pair of rollers 164, lowering the floating bar 146 and allowing the track assembly 88 to contact the surface of the concrete.

Figure 16:
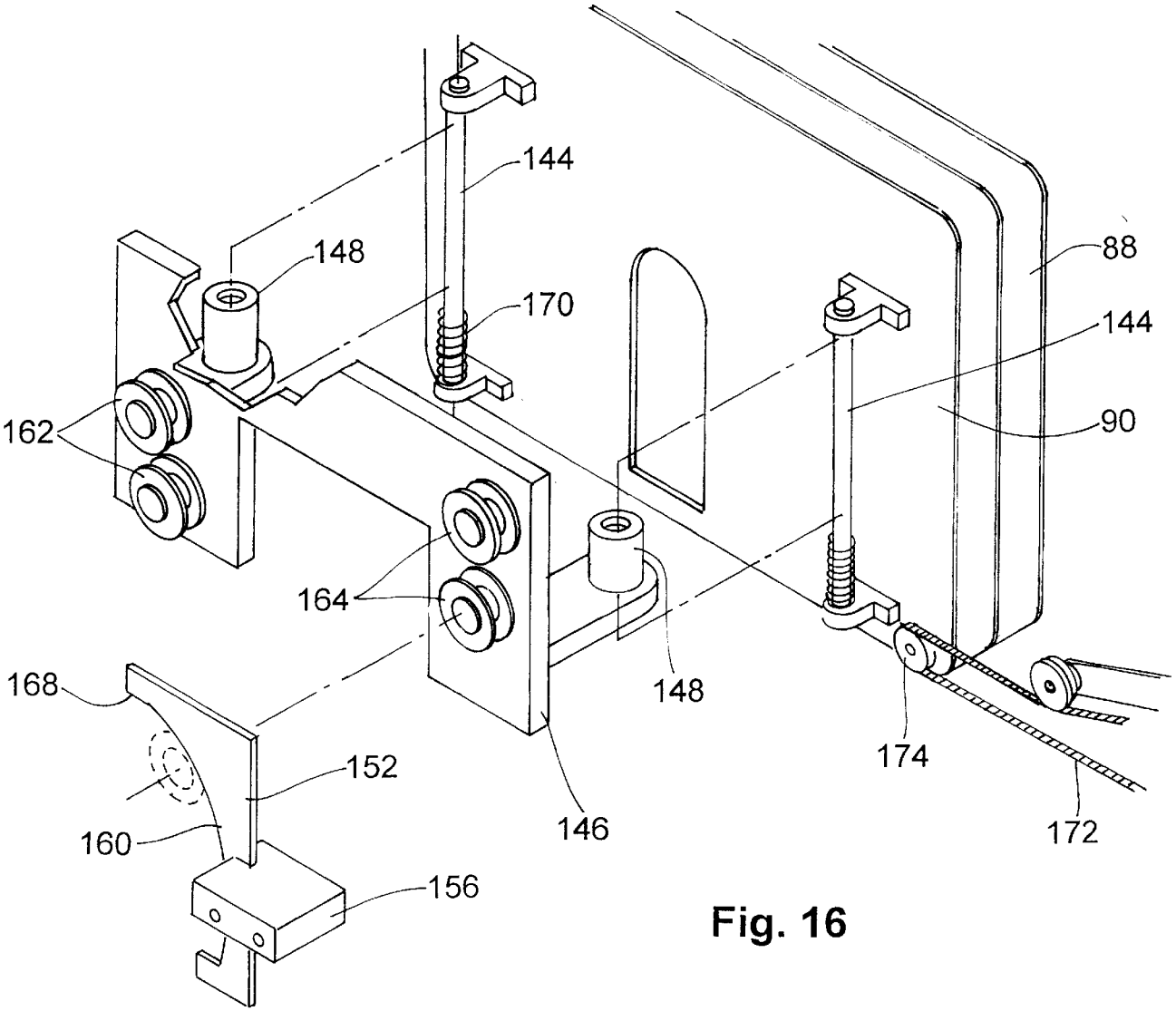
FIG. 16 is an exploded view of the guide means of the track assembly of FIG. 13.

The floating bar 146 can pivot about its midpoint with the rollers following the arcuate surfaces of the guide plates 150 and 152 to allow the tracks 102 to ride flat on the concrete surface. When the saw blade 30 is fully engaged in the concrete to its desired depth, the linear bearings 148 are forced against compression springs 170 on the guide rails 144, as shown in FIG. 16, to press the tracks 102 firmly against the concrete.

It will be recognized by the skilled artisan from the present disclosure that various other types of linkages, which can be mechanically, hydraulically, or otherwise created, may be used to provide the desired engagement of the track assembly 88 with the surface of the concrete to be cut.

Figure 4:
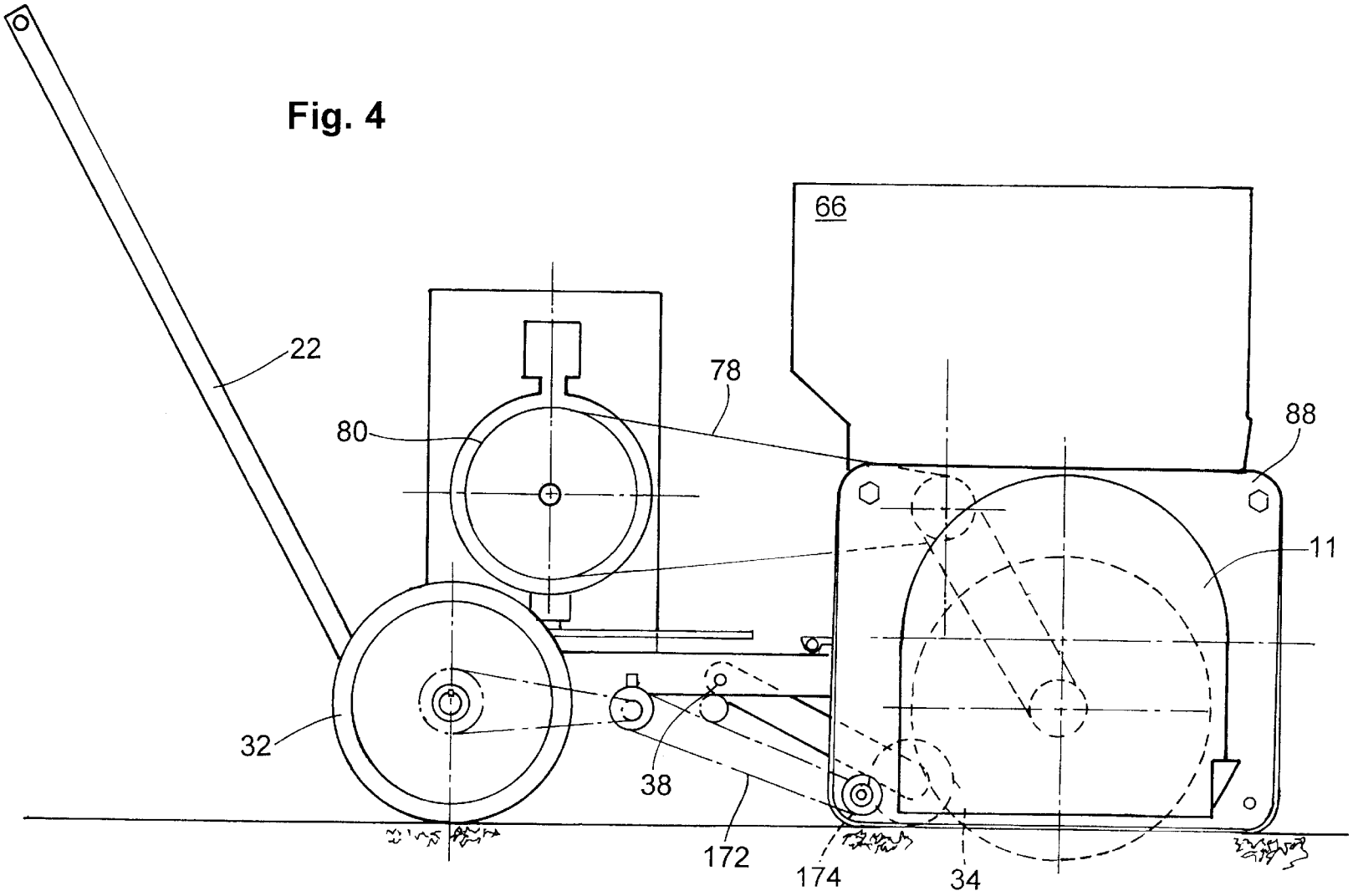
FIG. 4 is a left side elevational view of the concrete cutting saw of FIG. 1.

The tracks 102 are driven at generally the same speed as the forward travel of the saw over the concrete during cutting of the concrete. To accomplish this, a chain and sprocket drive 172 interconnects a sprocket 174 on the rear wheels 32 with the track drive wheels 96, for example as shown in FIG. 4, to coordinate the speed of the tracks 102 with the forward speed of the concrete saw.

Figure 5:
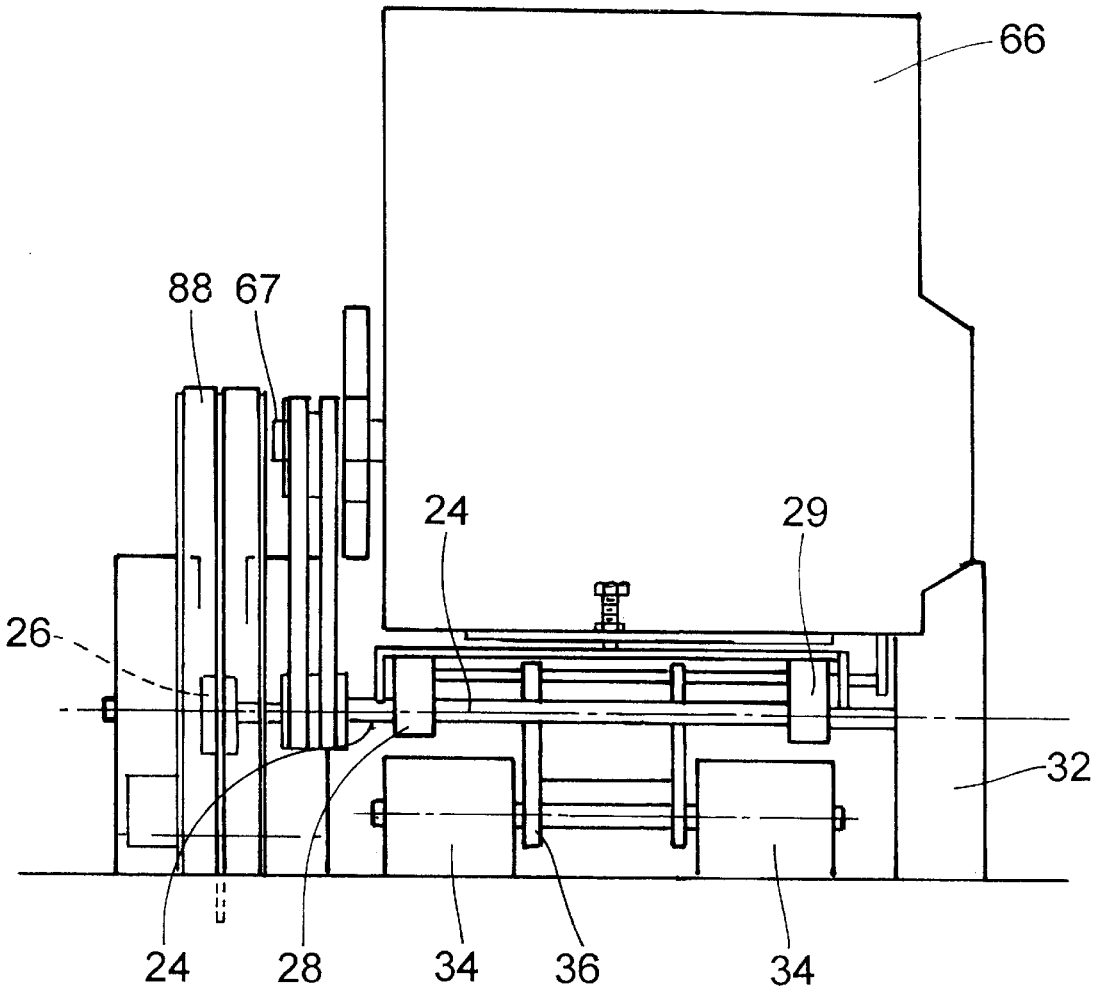
FIG. 5 is a front view of the concrete cutting saw.

As best shown in FIG. 5, there are two rear wheels 32 on the same side of the cutting saw 10 as the saw blade 30. They are spaced so that they straddle the saw kerf and overlap the path of travel of the tracks 102. This construction serves a dual function. First, it overcomes the drag of the saw blade during cutting to maintain a straight cutting path. In addition, it provides a wide footprint of pressure on either side of the saw kerf to force any displaced concrete due to the cutting operation down smooth with the surface of the concrete thereby providing a neat smooth saw cut with no raveling of the concrete adjacent the cut.

Figure 17:
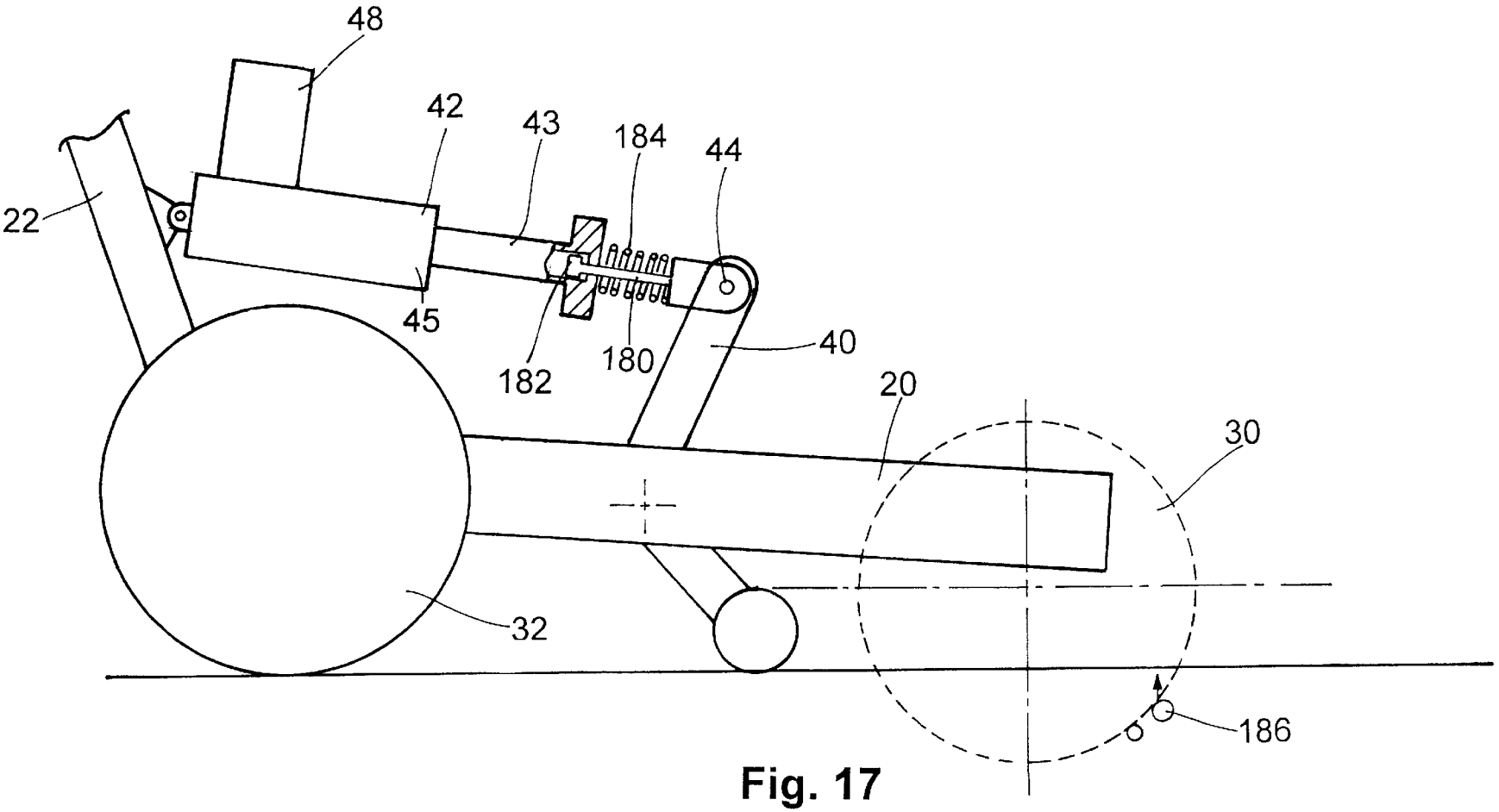
FIG. 17 is an enlarged view of a modified form of lift mechanism for the saw blade.

FIG. 17 illustrates a modification for the present invention which permits the saw blade 30 to lift or ride over a hard piece of aggregate in the concrete. In this embodiment, an extension member 180 is provided between the end of the crank arm 40 end of the feed screw or piston 43 with an enlarged head 182 slidably received within the member 43. A compression spring 184 bearing against the end of the member 43 exerts a force to the right with respect to FIG. 17 on the crank arm 40. If the saw blade 30 contacts a hard piece of aggregate, such as shown at 186, the spring member will permit the saw blade and main frame to lift upwardly against the force of the spring to allow the saw blade to ride over the hard aggregate.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A saw for cutting green and uncured concrete comprising;

a frame having forward and rear ends;

a handle fixed to the frame for guiding the saw across a surface of the green and uncured concrete to be cut;

front and rear wheels supporting the frame above the concrete surface;

a rotatable saw blade adjacent one side of the frame for cutting the concrete;

a motor drive carried by the frame drivingly interconnected with the saw blade to rotate the saw blade;

a linkage connected to the front wheels such that the frame is movable relative to the front wheels so that the forward end of the frame can be moved generally vertically relative to the surface of the concrete to engage the saw blade into the concrete and withdraw the saw blade from the concrete;

a track assembly surrounding the saw blade and carried by said frame;

a pair of endless tracks on said track assembly, each track moving relative to the frame and having a lower run which engages and supports the surface of the concrete when the saw blade is engaged in the concrete; and said track assembly being mounted on said frame by a second linkage for movement with the frame prior to engagement of the concrete by the saw blade and movement relative to said frame after the saw blade contacts the surface of the concrete.

2. A saw for cutting green and uncured concrete in accordance with claim 1 wherein said track assembly is mounted for movement in a generally vertical direction relative to said frame.

3. A saw for cutting green and uncured concrete in accordance with claim 2 wherein said track assembly is mounted for pivotal movement about the axis of rotation of said saw blade.

4. A saw for cutting green and uncured concrete in accordance with claim 1 wherein said motor drive drives the rear wheels of said saw to propel the saw over the surface of the concrete being cut.

5. A saw for cutting green and uncured concrete in accordance with claim 4 wherein said motor drive drives the tracks a same peripheral speed which is the same as a peripheral speed of the rear wheels.

6. A saw for cutting green and uncured concrete in accordance with claim 1 wherein the linkage includes a crank arm pivoted to the frame, the front wheels being carried by the crank arm, and an actuator connected to said crank arm.

7. A saw for cutting green and uncured concrete in accordance with claim 6 wherein said actuator includes a motor driven feed screw.

8. A saw for cutting green and uncured concrete in accordance with claim 6 wherein said actuator includes a hydraulic piston.

9. A saw for cutting green and uncured concrete in accordance with claim 6 wherein a resilient member is positioned between said actuator and said crank arm to permit limited movement of said front wheels relative to said frame.

10. A saw for cutting green and uncured concrete in accordance with claim 9 wherein said resilient member is a compression spring.

11. A saw for cutting green and uncured concrete in accordance with claim 1 wherein said saw blade is completely retracted within said track assembly when said saw blade is withdrawn from the concrete.

12. A saw for cutting green and uncured concrete in accordance with claim 11 wherein said track assembly comprises front and back plates; and a track assembly linkage mechanism interconnecting said back plate with said frame to permit limited vertical and rotary movement of said track assembly relative to said frame.

13. A saw for cutting green and uncured concrete in accordance with claim 12 wherein rotary guide wheels are provided between said front and back plates;

and said pair of tracks pass over said guide wheels.

14. A saw for cutting green and uncured concrete in accordance with claim 13 wherein the guide wheels are driven by said motor drive to cause the tracks to roll over the surface of the concrete.

15. A saw for cutting green and uncured concrete in accordance with claim 14 wherein the lower run of the tracks which engage the concrete at the bottom of the track assembly project beyond the edges of the front and back plates.

16. A saw for cutting green and uncured concrete in accordance with claim 15 wherein guide members are located between the front and back plates in sliding engagement with the lower run of the tracks to support the tracks in engagement with the concrete being cut.

17. A saw for cutting cured and uncured concrete in accordance with claim 16 wherein said guide members are formed of a smooth plastic material.

18. A saw for cutting green and uncured concrete in accordance with claim 17 wherein said guide members are spaced apart at opposite sides of the saw blade to form a slot through which the saw blade can project into engagement with the concrete.

19. A saw for cutting green and uncured concrete in accordance with claim 18 wherein a central plate is provided generally of the same size as the front and back plates, a central cutout being provided in the central plate which surrounds the saw blade, said central plate extending between and below said guide members.

20. A saw for cutting green and uncured concrete in accordance with claim 19 wherein a continuous shield having lower end portions in engagement with said guide plates extends between said front and back plates and surrounds the saw blade.

21. A saw for cutting green and uncured concrete in accordance with claim 20 having a discharge chute for concrete dust extending through the front plate.

22. A saw for cutting green and uncured concrete comprising:

a frame;

a handle fixed to the frame for guiding the saw across a surface of the concrete to be cut;

wheels supporting the frame above the concrete surface; a rotatable saw blade adjacent one side of the frame for cutting the concrete;

a motor drive carried by the frame interconnected with the saw blade to rotate the same;

a linkage attached between the frame and at least one wheel to move the frame toward and away from the surface of the concrete to engage the saw blade into the concrete and withdraw the saw blade from the concrete;

a track assembly surrounding the saw blade and carried by said frame;

a pair of endless tracks on said track assembly each track moving relative to the frame and having a lower run which is adapted to engage and support the surface of the concrete when the saw blade is engaged into the concrete; and said track assembly mounted on said frame for movement with the frame prior to engagement of the concrete by the saw blade and movement relative to said frame after the saw blade contacts the surface of the concrete.

23. A saw for cutting green and uncured concrete in accordance with claim 22 wherein said track assembly is mounted for movement in a generally vertical direction relative to said frame.

24. A saw for cutting green and uncured concrete in accordance with claim 23 wherein said track assembly is mounted for pivotal movement about the axis of rotation of said saw blade.

25. A saw for cutting green and uncured concrete in accordance with claim 23 wherein said track assembly comprises generally rectangular front and back plates; and a track assembly linkage mechanism interconnecting said back plate with said frame to permit limited vertical and rotary movement of said track assembly relative to said frame.

26. A saw for cutting green and uncured concrete in accordance with claim 25 wherein rotary guide wheels are provided between said front and back plates;

and said pair of tracks pass over said guide wheels.

27. A saw for cutting green and uncured concrete in accordance with claim 26 wherein at least one guide wheel is driven by said motor drive to cause the tracks to roll over the surface of the concrete.

28. A saw for cutting green and uncured concrete in accordance with claim 27 wherein the lower run of the tracks which engage the concrete at the bottom of the track assembly project beyond the edges of the front and rear plates.

29. A saw for cutting green and uncured concrete in accordance with claim 28 wherein guide members are attached to the front and back plates and engage the lower run of the tracks to support the tracks in engagement with the concrete being cut.

30. A saw for cutting green and uncured concrete in accordance with claim 29 wherein said guide members are spaced apart at opposite sides of the saw blade to form a slot through which the saw blade can project into engagement with the concrete.

31. A saw for cutting green and uncured concrete in accordance with claim 30 wherein a central plate is provided generally of the same size as the front and back plates with a central cutout surrounding the saw blade, said central plate extending between and below said guide members.

32. A saw for cutting green and uncured concrete in accordance with claim 31 wherein a continuous shield having lower end portions in engagement with said guide plates extends between said front and back plates and surrounds the saw blade.

33. A saw for cutting green and uncured concrete in accordance with claim 25 wherein said track assembly linkage mechanism includes forward and rearward support brackets carried by said frame;

guide wheels carried by each of said support brackets engage the front and back plates to guide vertical movement of said track assembly;

forward and rearward bifurcated linkage mechanisms each having an upper end pivotally connected to a support bracket and a lower end pivotally connected to said rear plate; and spring means interconnecting said forward and rearward bifurcated linkage mechanisms to exert a downward force on said rear plate.

34. A saw for cutting green and uncured concrete in accordance with claim 25 wherein said track assembly linkage mechanism includes forward and rearward support brackets carried by said frame;

forward and rearward guide rods extending generally vertically on said back plate;

forward and rearward guide plates carried by said forward and rearward support brackets, respectively, each having an arcuate guide surface;

a floating bar extending between said forward and rearward guide plates mounted for sliding movement on said guide rods; and a pair of rollers at each end of said floating bar, one of said pair of rollers in engagement with the arcuate guide surface of the forward guide plate and the other of said pair of rollers in engagement with the arcuate guide surface of the rearward guide plate.

* * * * *